US005967343A

United States Patent [19]

Dufresne

[11] Patent Number: 5,967,343

[45] Date of Patent: Oct. 19, 1999

[54] DISPLAY ASSEMBLY

[76] Inventor: Ronald Dufresne, 2207 Arbor Forest Trail, Marietta, Ga. 30064

[21] Appl. No.: 08/978,409

[22] Filed: Nov. 25, 1997

[51] Int. Cl.[6] ..... A47F 5/00

[52] U.S. Cl. ..... 211/86.01; 40/661.03

[58] Field of Search ..... 211/57.1, 86.01, 211/54.1; 40/661.03

[56] References Cited

U.S. PATENT DOCUMENTS

| | | | |
|---|---|---|---|
| 2,679,846 | 6/1954 | Addison | 129/16.7 |
| 2,761,230 | 9/1956 | Finnegan | 40/11 |
| 2,950,554 | 8/1960 | Foster | 40/16 |
| 3,024,915 | 3/1962 | Toppi | 211/86.01 |
| 3,320,690 | 5/1967 | Forsburg | 40/10 |
| 3,530,605 | 9/1970 | Gutterson | 40/11 |
| 3,889,408 | 6/1975 | Offner | 40/661.03 |
| 3,955,296 | 5/1976 | Kapstad | 40/11 |
| 4,373,693 | 2/1983 | Greenberger | 248/221 |
| 4,405,051 | 9/1983 | Thalenfeld | 211/57.1 |
| 4,426,797 | 1/1984 | Burkemper et al. | 40/16.4 |
| 4,532,726 | 8/1985 | Kenney | 40/16.4 |
| 4,556,183 | 12/1985 | Greenberger | 248/221.4 |
| 4,698,928 | 10/1987 | Soporowski | 40/16.4 |
| 4,716,669 | 1/1988 | Fast | 40/16.2 |
| 4,805,331 | 2/1989 | Boggess et al. | 40/651 |
| 4,821,437 | 4/1989 | Abramson et al. | 40/342 |
| 4,881,707 | 11/1989 | Garfinkle | 248/221.4 |
| 4,909,464 | 3/1990 | Levine et al. | 248/225.1 |
| 5,042,768 | 8/1991 | Goldstein | 248/225.1 |
| 5,237,767 | 8/1993 | Kringel et al. | 40/642 |
| 5,381,908 | 1/1995 | Hepp | 211/184 |
| 5,408,755 | 4/1995 | Abramson et al. | 40/642 |
| 5,473,833 | 12/1995 | Ostrovsky | 40/661.03 |
| 5,488,793 | 2/1996 | Gebka et al. | 40/661.03 |
| 5,682,698 | 11/1997 | Bevkins | 40/661.03 |
| 5,788,089 | 8/1998 | Garfinkle | 211/57.1 |
| 5,826,359 | 10/1998 | Thalenfeld et al. | 211/57.1 |

*Primary Examiner*—Blair M. Johnson

*Attorney, Agent, or Firm*—Womble Carlyle Sandridge & Rice

[57] ABSTRACT

This disclosure is directed to an inexpensive, in-store display assembly for being engagable with the edge of a gondola-type shelving system. Disclosed are several embodiments for a vertically suspendable display panel featuring a C-configured channel for engaging the shelf edge. A further feature of the unit is a perpendicularly projecting display member for removably attaching to the panel edge.

16 Claims, 3 Drawing Sheets

DISPLAY ASSEMBLY

FIELD OF THE INVENTION

This invention relates to a horizontal display assembly, including a perpendicular display extension, where the display assembly may be removably attached to a gondola type shelf system. The display unit of the present invention, of which there are several embodiments, may be conveniently snapped onto a gondola shelf price channel, or slidably engaged with an extension along the shelf edge.

BACKGROUND OF THE INVENTION

Merchandising, or point-of-sale in store displays are commonly used to attract customers within a store to a specific product or location in the store in order to entice the customer to purchase a given product or service. Such promotional means typically may take the form of graphic displays, such as banners, headpieces, and other printed materials suspended adjacent, or attached to the product display units. Often these graphic displays cannot be readily assembled in the store by store personnel, or are self-standing units which can interfere both with customer flow or with the display of the products themselves. Typically, these known promotional displays are made for a single graphic item only, and must be discarded or removed when the new material or promotional item is advertised.

A need has thus arisen for a portable and inexpensive system for providing a convenient and prominent device for displaying in-store promotional information. The prior art, as reflected in a number of patents, offers some convenient apparatus for identifying and/or promoting products in a merchandising environment. The following are several exemplary prior art systems developed for product promotion.

U.S. Pat. No. 4,556,183, to Greenberger, discloses an integral clip assembly for holding a graphic display that would be projected laterally from a store shelf into the aisle for easy viewing by shoppers frequenting the store. The clip assembly comprises a generally J-shaped body adapted for receiving a sign or marker, and opposing flanges for securing the clip to a shelf molding, which itself includes an upper and lower flange. The assembly is substantially resilient so that it may easily be snapped within the shelf molding. A clip portion, formed by the loop of the J-shaped body, is also resilient to provide a firm grip upon a sign or marker positioned therein.

U.S. Pat. No. 4,698,928, to Soporowski, discloses a sign holder which is slidably mounted on a retail store shelf, or other supports having top and bottom channels, in which a horizontal graphic display may be received. A preferred embodiment thereof includes the structure needed to slidably mount the sign holder within spaced, open longitudinal cylindrical recesses with parallel walls extending along the opening of the recess, and extending necks with longitudinal cylindrical projections at the end. The projections are receivable in the recesses with the parallel walls being the necks so that there is little pivoting between the sign and its support.

U.S. Pat. No. 5,042,768, to Goldstein, discloses a self mounting, advertising device for retail sales promotion and advertising. The device includes a placard to be suspended from a shelf, having an elongate card which is folded to form a front panel and a side panel. The side panel is positioned substantially at right angles to the front panel and its upper edge abuts against the shelf when suspended from the front edge thereof by a suspender strap. The side panel supports the front panel at a predetermined angle relative to the vertical. The side panel may bear advertising indicia thereon which is visible when viewed from the side, and may be supported in its angular displacement from the front panel by a return panel which traverses the distance between the distal end of the side panel and the reverse side of the card.

The present invention provides an improvement to the in-store display systems of the prior art by the provision of a snap engagable display panel having a perpendicular extension therefrom that allows for the angular viewing thereof that can attract and guide potential customers from a distance down an aisle, for example, to the displayed products or merchandise.

SUMMARY OF THE INVENTION

The present invention is directed to an in-store type, advertising display unit which includes a perpendicular display extension therefrom, where such unit offers both at-site advertising and distance advertising opportunities. The display unit, adapted for mounting to a gondola-type shelving system having an edge, comprises a pair of inter-engaging components. A first component thereof consists of a vertically suspendable display panel engagable with the shelf edge. The display panel comprises an elongate, generally planar member, preferably a transparent plastic, having a series of sides including a first or upper end reversely bent therefrom through an angle of about 180 degrees, where the distal end of the first end terminates in a C-configured, channel-like portion sized for engagement with the shelf. The second or lower side or end may also be reversely bent therefrom through an angle of about 180 degrees, where the first and second ends cooperate with the transparent display panel to receive and display advertising information.

The second component comprises a display member extending perpendicular from and removably attached to an edge of the display panel, where the display member includes a pair of cooperating walls for slidably receiving therebetween a panel of additional advertising information.

A first embodiment for the display panel includes a horizontally disposed C-configured channel along its distal end for snap engaging a complementary bead along a shelf edge.

A second embodiment for the display panel includes an arcuate shaped portion terminating in a free edge having a C-configured channel therealong.

In a third embodiment for the display panel, the first or upper end includes a parallel portion having a pair of co-operative, spaced-apart tabs to define a channel in combination with the parallel portion. For alternate mounting of the invention, the channel may slidably engage a supported complementary panel.

It is, therefore, a object of this invention is to provide an inexpensive display assembly for use with advertising and promotional type information for a designated product or service, and for attracting potential customers from a remote location, such as down a store aisle, to the spot of the product or service.

Another object hereof is the provision of a horizontal graphic holder with an attached vertical graphic holder for mounting, such as by snapping onto a variety of gondola shelf fronts.

The manner by which the improvements, objects, and features are achieved may be appreciated from the specification which follows, particularly when read in conjunction with the accompanying drawings.

DETAILED DESCRIPTION OF PREFERRED EMBODIMENTS

Figure 1A:
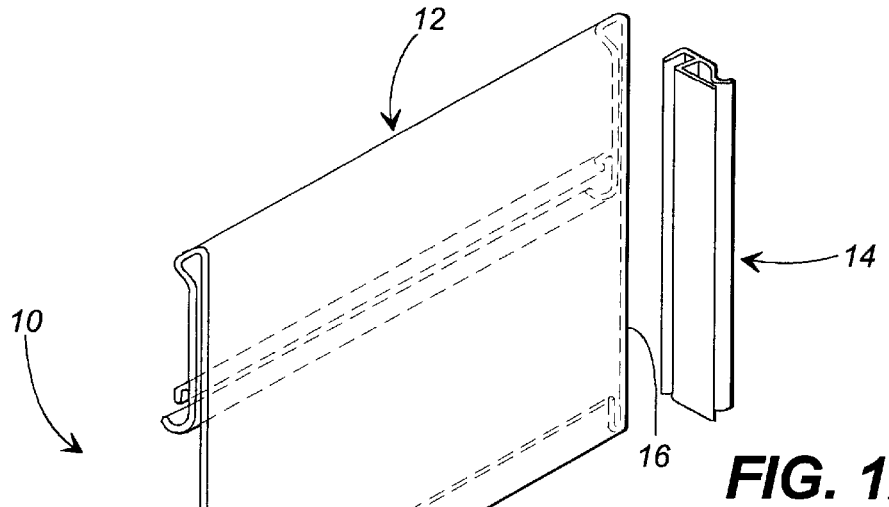
FIGS. 1A through 1C are exploded perspective views of three embodiments for an in-store, suspendable, two-component, display assembly for receiving promotional and advertising information, according to the present invention.

The present invention is directed to a two component, in-store display system featuring a horizontal display unit having a removably attached perpendicular display extension, where such arrangement may be secured to a variety of gondola type shelving arrangements. Several embodiments for the construction of the display system are disclosed and illustrated in FIGS. 1–7, where like reference numerals denote like parts throughout the different views.

Figure 1B:
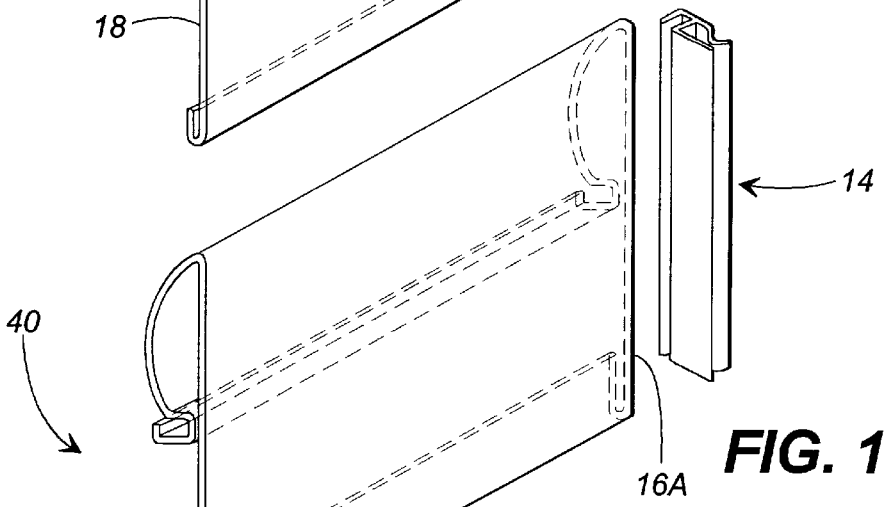
Figure 1C:
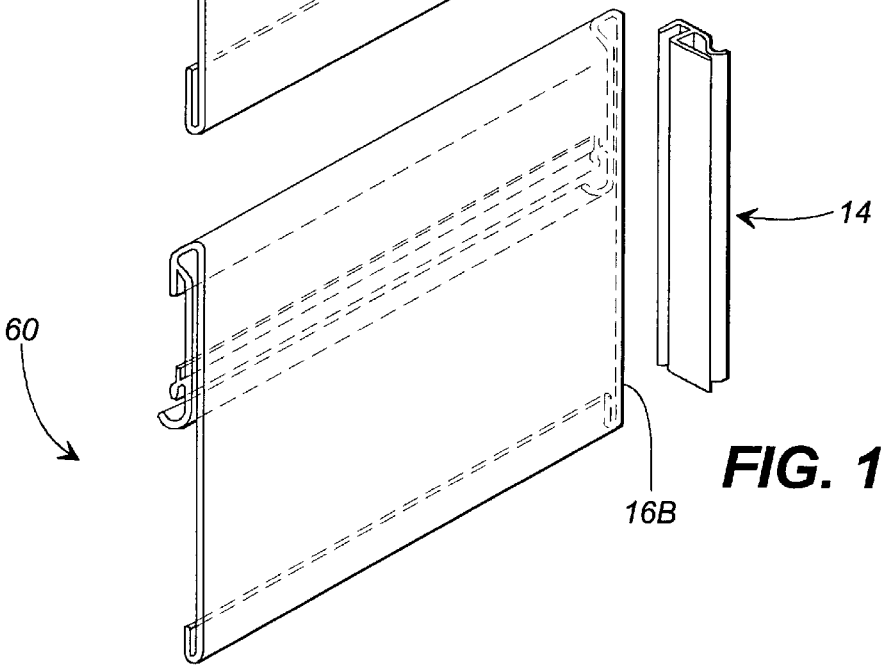
Figure 2:
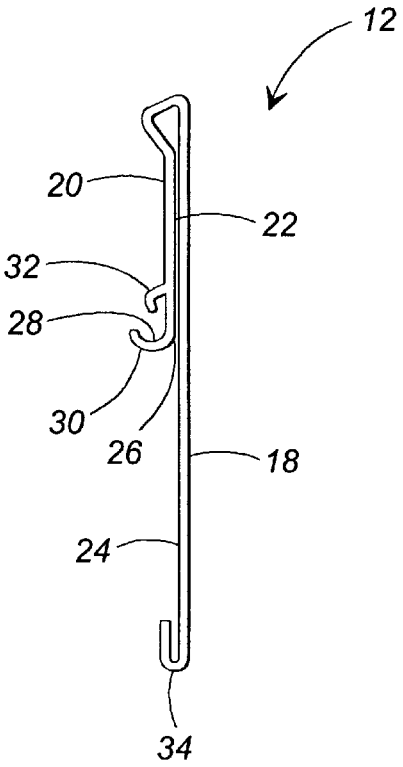
FIG. 2 is an enlarged end view illustrating the profile of the first informational display component for the first embodiment of FIG. 1A.

FIGS. 1A through 1C, respectively, represent three preferred embodiments of the two component, in-store display system according to this invention. FIG. 1A illustrates a first embodiment for the in-store display system 10, where such system comprises a horizontal display unit 12 and a display extension 14 for removably attaching to an edge 16 of the display unit 12. The display unit 12 is preferably molded of a clear material, such as plastic, to allow reading of displayed information mounted along the rear face thereof, as hereinafter explained. As best seen in FIG. 2, the cross section of the display unit 12 is essentially uniform such that the unit may be extrusion molded of selected lengths and cut to fit the needs of the store and shelving arrangement to which it is to be attached.

The display unit 12 comprises a planar member 18 having a first or upper end 20 reversely bent about 180 degrees such that at least a portion 22 thereof lies in close proximity to the rear face 24 of planar member 18. The distal end 26 of upper end 20 includes an elongate channel 28 defined by the upturned edge 30 and an L-shaped angular extension 32 from portion 22. The channel 28 allows for the ready attachment of the display unit to a shelf edge, such as a gondola shelf price channel, as known in the art. The opposite or lower end 34 may also be reversely bent, such as about 180 degrees, where such upper and lower ends 20, 34 define an elongate narrow channel for receiving display information that is visible through the transparent planar member.

Figure 3:
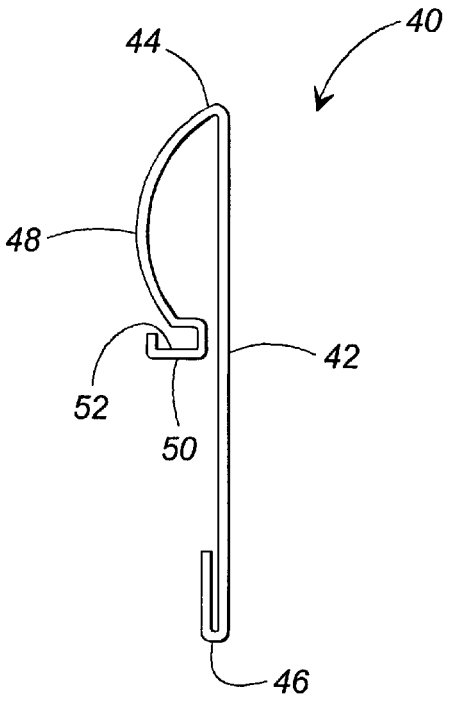
FIG. 3 is an enlarged end view, similar to FIG. 2, illustrating the first informational display component for the second embodiment of FIG. 1B.

FIGS. 1B and 3 illustrate a second embodiment for a display unit 40 according to this invention. Like the embodiments of FIGS. 1A and 1C, the display unit 40 includes a planar member 42 having its upper and lower ends 44, 46 respectively, reversely bent through an angle of about 180 degrees. However, the upper end 44 features an arcuate configured wall portion 48 whose distal end 50 terminates in an elongate, C-configured channel 52. Since a common mounting or attachment means is to a gondola shelf price channel, which as known in the art comprises an arcuate configured channel member, having upper and lower beaded edges, (see FIGS. 6A and 6B), the portion 48 is configured to lie in close proximity to the shelf price channel while the C-configured channel 52 engages the lower beaded edge, for example. This arrangement offers additional stability to the display unit 40.

Figure 4:
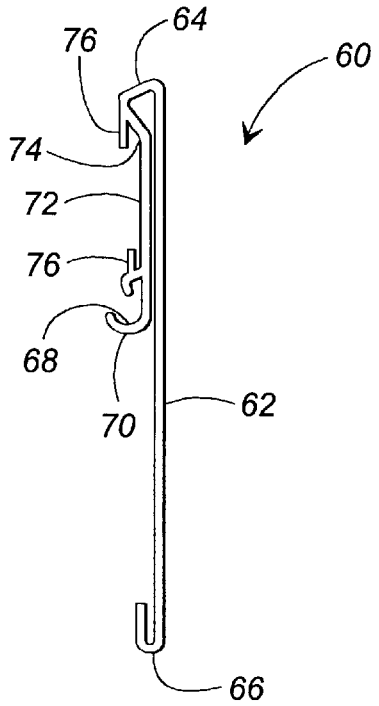
FIG. 4 is an enlarged end view, similar to FIGS. 2 and 3, illustrating the first informational display component for the third embodiment of FIG. 1C.

The third embodiment, as illustrated in FIGS. 1C and 4, is similar to the display units 10, 40. The display unit 60 of this third embodiment comprises a planar member 62 with its respective upper and lower ends 64, 66, respectively, reversely bent there behind through an angle of about 180 degrees. The upper end 64, in addition to the C-configured channel 68, at its distal end 70, includes an intermediate wall portion 72, essentially parallel to planar member 62. Cooperating with said wall portion 72, to form a channel 74, are a pair of planarly aligned wall extensions 76, or flanges. As will be apparent in the further description which follows, particularly as to FIG. 7, this arrangement offers an alternate manner of mounting the display unit 60 to a shelving unit.

Figure 5:
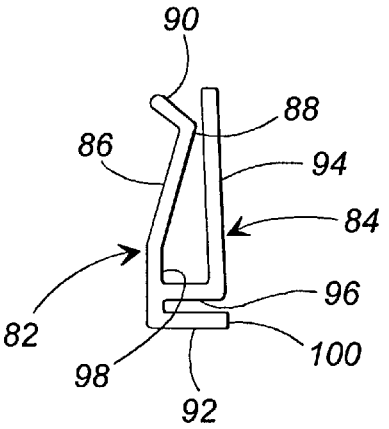
FIG. 5 is an enlarged end view illustrating the profile of the second component according to this invention, where respective second components are further shown in FIGS. 1A through 1C positioned for engagement with a respective first informational display component.

The second component 14, or perpendicular display extension of the system hereof, common to the three embodiments of FIGS. 1A through 1C, is illustrated therein as well as in FIG. 5. The perpendicular display extension 14, preferably molded of a resilient material, such as plastic, comprises an integral component consisting of a pair of L-shaped members 82, 84, as best seen in FIG 5. A first such member 82 includes first leg 86, reversely bent 88 at one end 90, and a second leg 92. The second such member 84 includes a first planar leg 94 which is positioned in close proximity to the bend 88, where the respective first legs 86, 94 co-operate to receive and retain a panel of informational or advertising information therebetween, and a second leg 96. The respective second legs 92, 96, where the end 98 of second leg 96 is integrally molded to first leg 86, cooperate to form a laterally extending channel 100 therebetween. The channel 100 is of a dimension to slidably engage the respective vertical edges 16, 16*a*, 16*b*, of one of respective planar members 18, 42, 62. FIGS. 1A through 1C illustrate the display extension 14 poised for engagement with a respective planar member.

Figure 6A:
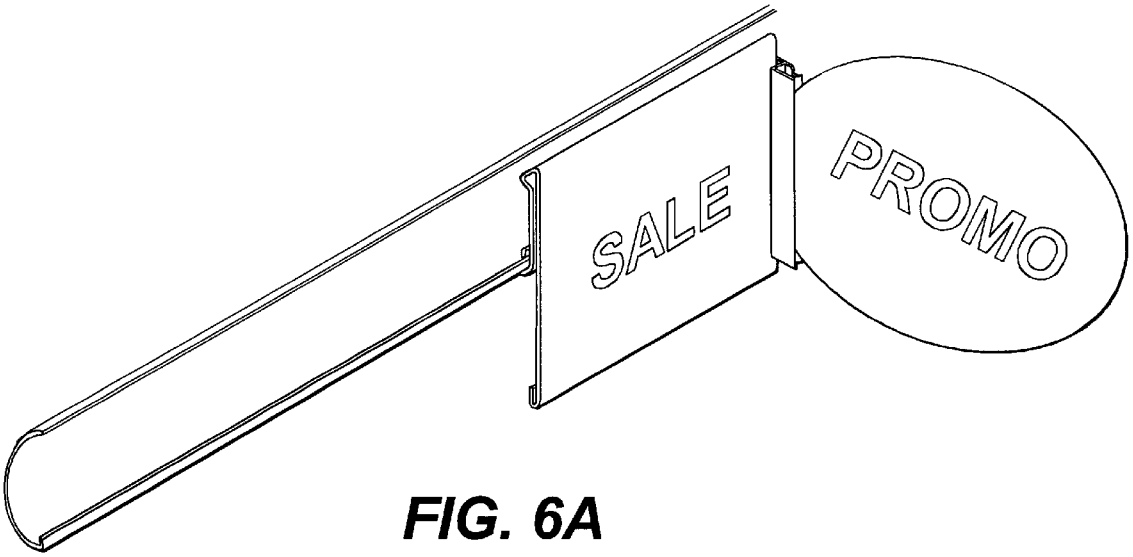
FIGS. 6A and 6B are perspective views of the assembled two-component display assembly of this invention, particularly the embodiments of FIGS. 1A and 1B, respectively, suitably mounted to a shelf, or more precisely a shelf price channel, as known in the art.
Figure 6B:
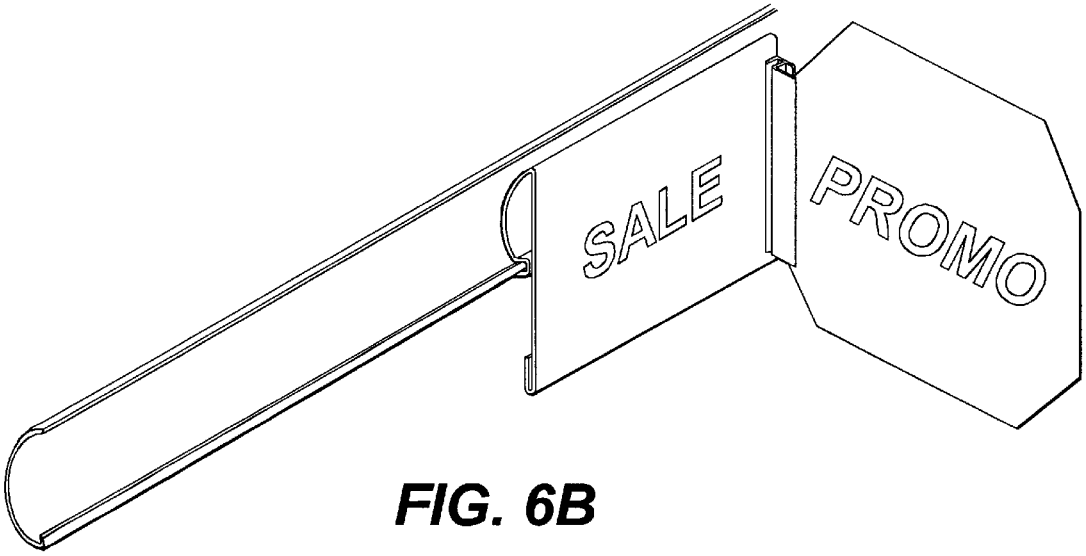

FIGS. 6A and 6B are simplified perspective views illustrating the assembled and shelf mounted, two component, in-store display system of this invention, particularly the embodiments of FIGS. 1A and 1B. The bi-dimensional display unit, as illustrated in FIGS. 6A and 6B, offers both at-site advertising information, depicted as "SALE", and a more distant advertising information, depicted as "PROMO", to a potential customer who sees the PROMO and is to the at-site SALE.

Figure 7:
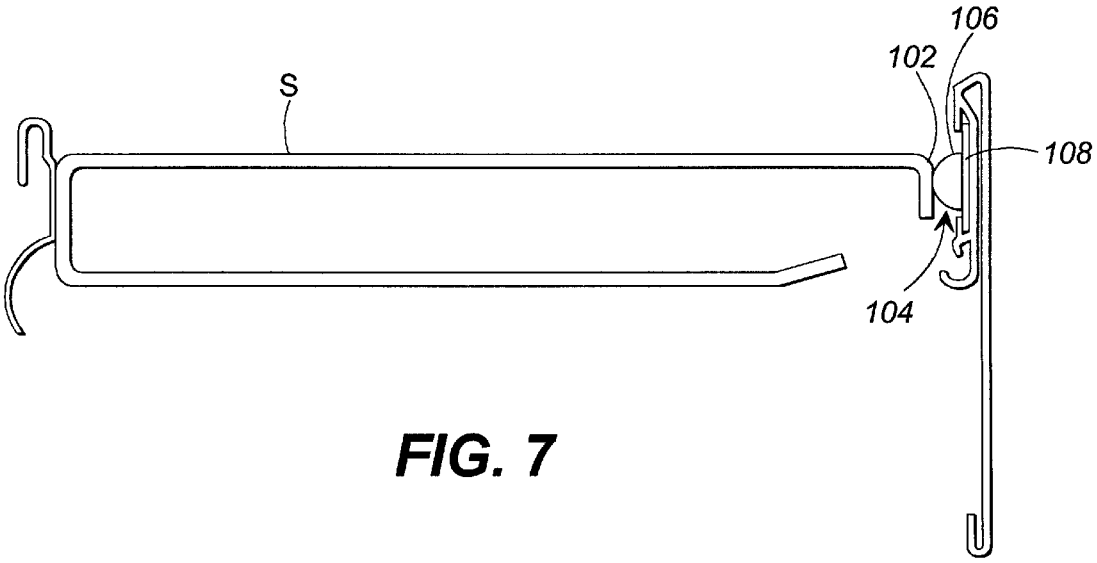
FIG. 7 is an enlarged side view illustrating a display shelf and an alternate mounting means for the embodiment illustrated in FIG. 1C.

While the prior discussions have been directed to mounting of the display unit by means of the C-configured channel to an edge bead of a shelf, for example, FIG. 7 illustrates an alternate manner of mounting the display assembly to a shelf unit 5 (the shelf shown in side view), particularly the third embodiment of FIGS. 1C and 4. To accomplish this alternate manner of mounting, the shelf edge 102 may be provided with an essentially T-shaped attachment 104 comprising a base 106 and a planar vertically oriented cap 108, where the cap 108 is sized to slidably engage the channel 74 (FIG. 4).

While several embodiments have been described above, it is recognized that variations may be had with respect to the components of the several embodiments for an inexpensive, in-store display system in accordance with this invention. Therefore, while the invention has been disclosed in preferred forms only, it will be obvious to those skilled in the art that many additions, deletions and modifications can be made therein without departing from the spirit and scope of this invention, and no undue limits should be imposed thereon except as set forth in the following claims.

We claim:

1. In combination with a gondola-type shelving system having a horizontally disposed edge therealong of a predetermined length, a.) a vertically suspendable display panel engagable with said edge, said display panel comprising an elongate, generally planar member of said predetermined length having a first side reversely bent therefrom through an angle of about 180 degrees, where a distal end of said first side terminates in a C-configured, channel-like portion for engagement with said edge to support said display panel thereon; and, b.) a vertically disposed display member extending perpendicular from and removably attached to an edge of said display panel, where said display member includes a pair of cooperating walls for slidably receiving therebetween a panel of display information.

2. The combination according to claim 1, wherein a second side of said display panel is reversely bent therefrom through an angle of about 180 degrees, whereby to vertically position said display member and maintain its spatial relationship to said display panel.

3. The combination according to claim 1, wherein a portion of said first side lies parallel to said display panel, further including a pair of spaced and opposed wall portions to define an elongate channel with said portion, where said channel is adapted for sliding engagement with said edge.

4. The combination according to claim 3, wherein said display member is formed of a transparent material, and said elongate channel is sized to receive a panel containing information to be displayed therein.

5. The combination according to claim 1, wherein said display member comprises an integral member having a pair of generally L-shaped members, where respective first legs of said members are said cooperating walls, and the respective second legs thereof define a channel essentially perpendicular to said first legs.

6. A display system, comprising:

a gondola-type shelf having an edge;

a display panel removably engaged to said edge of said shelf, said display panel comprising an elongated, generally planar member having a first side reversely bent thereover, said first side having a distal end terminating in a channel portion, said channel portion being in selective engagement with said edge of said shelf to support said display panel thereon; and a display member removably attached to said display panel and extending outwardly therefrom, said display member including means for holding an information-displaying panel.

7. The display system of claim 6, wherein said means for holding an information displaying panel comprises a pair of cooperating walls for slidably receiving an information-displaying panel therebetween.

8. The display system of claim 6, wherein said channel portion of said distal end is arcuate shaped.

9. The display system of claim 8, wherein:

said edge of said shelf includes a T-shaped attachment; and said arcuate shaped channel on said distal end of said display panel slidably engages said T-shaped attachment of said edge of said shelf.

10. The display system of claim 9, wherein said arcuate shaped channel on said distal end includes a pair of spaced and opposed wall portions for slidably engaging said T-shaped attachment.

11. The display system of claim 6, wherein said first side of said display panel is reversely bent at an angle of about 180° from said display panel.

12. A display assembly in selective engagement with the edge of a gondola-type shelf, said display system comprised of:

a display panel comprising an elongated generally planar member having a first side reversely bent thereover, said first side having a distal end terminating in an arcuate shaped portion, whereby said arcuate shaped portion selectively engages with the edge of the shelf to secure said display assembly to the shelf to support said display assembly thereon; and a display member removably attached to said display panel and extending outwardly therefrom, said display member including means for holding an information-displaying panel.

13. The display assembly of claim 12, wherein said means for holding an information displaying panel comprises a pair of cooperating walls for slidably receiving an information-displaying panel therebetween.

14. The display assembly of claim 13, wherein said first side of said display panel is reversely bent at an angle of about 180° from said display panel.

15. The display assembly of claim 12, wherein said channel-like portion of said distal end is a C-configured channel.

16. The display assembly of claim 15, wherein said C-configured channel on said distal end includes a pair of spaced and opposed wall portions.

* * * * *